United States Patent [19]

Dapper et al.

[11] Patent Number: 4,733,869

[45] Date of Patent: Mar. 29, 1988

[54] DISARMAMENT GAME APPARATUS

[76] Inventors: Jeff Dapper, 6239 Sultana, Temple City, Calif. 91780; Rudy DePooter, 1 Trail Ridge Cir., Pomona, Calif. 91766; Anthony Poplawski, 540 S. Catalina #507, Los Angeles, Calif. 90020

[21] Appl. No.: 851,714

[22] Filed: Apr. 14, 1986

[51] Int. Cl.[4] ..... A63F 3/00; A63F 3/02

[52] U.S. Cl. ..... 273/236; 273/255; 273/262; 273/291

[58] Field of Search ..... 273/278, 1 GF, 291, 273/288, 242, 248, 255, 262, 236

[56] References Cited

U.S. PATENT DOCUMENTS

| | | | |
|---|---|---|---|
| 3,424,455 | 1/1969 | Dunson | 273/1 GF |
| 3,697,072 | 10/1972 | Park . | |
| 3,799,551 | 3/1974 | Erickson . | |
| 4,032,154 | 6/1977 | Magiera . | |
| 4,159,117 | 6/1979 | Kuna | 273/243 |
| 4,191,379 | 3/1980 | DaVia . | |
| 4,239,229 | 12/1980 | Crossley . | |
| 4,354,682 | 10/1982 | Vcala | 273/1 GF |
| 4,560,169 | 12/1985 | North | 273/242 |
| 4,560,170 | 12/1985 | Enyi | 273/248 |
| 4,589,664 | 5/1986 | Slimp | 273/1 GF |

*Primary Examiner*—Richard C. Pinkham

*Assistant Examiner*—Benjamin Layno

*Attorney, Agent, or Firm*—Sheldon & Mak

[57] ABSTRACT

A game apparatus comprises a board having a playing area divided into two cartels. Each cartel is allocated an equal number of weighted contest tokens which are placed within each cartel. Players wager contest tokens in successive rounds of play. A spinner determines whether contest tokens wagered for each turn will be removed from or added to the playing area. The number of tokens wagered are determined by player selected groups of transaction outcomes and a chance device. Contest tokens removed from the playing area are placed on a designated side of a calibrated scale. With the completion of each turn, the balance or imbalance of the scale determines the odds of the outcomes for each cartel in the following turn. Cards from one of two sets are drawn by each cartel at the end of each turn, one set for the cartel achieving the greatest disarmament in the turn, the other set for the other cartel. Each cartel may accumulate cards for redemption at a later turn. Disarmament is achieved by limiting the number of tokens added to the playing area, and increasing the number of contest tokens removed from the playing area. The cartel which first removes all its contest tokens from the playing area, having accumulated sufficient redemptive card value to account for the remaining tokens in the other cartel, is the winner.

7 Claims, 10 Drawing Figures

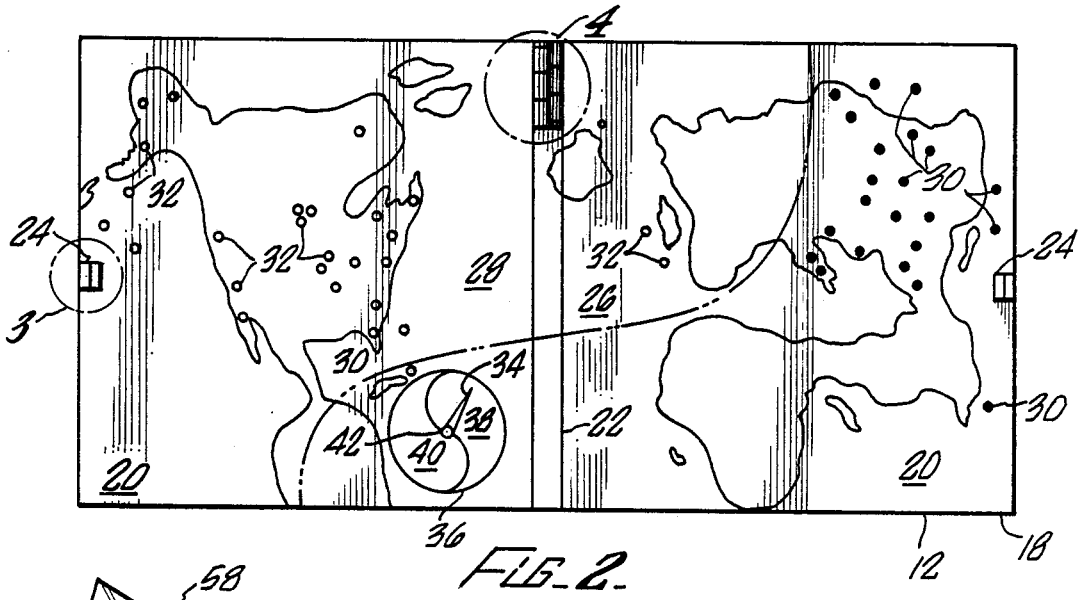
FIG. 2.
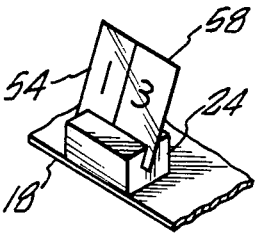
FIG. 3.
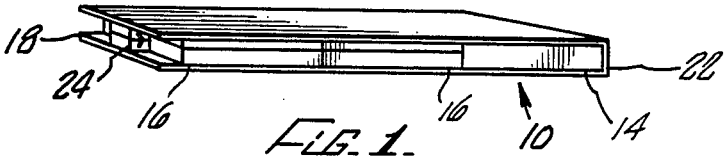
FIG. 1.
FIG. 4.
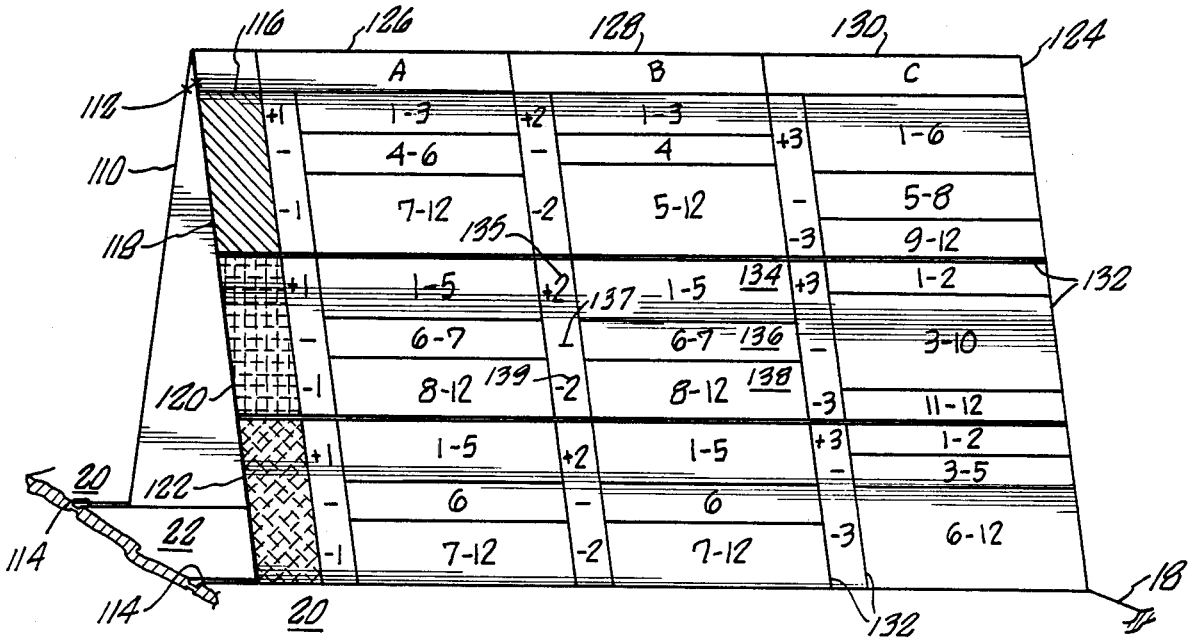

191
196
98
197
192
194
193
195
70
100
76
82
80
96
94
92
78
101
84
86
88
90
74
72

195
193
199
191
192
194
198
98

1
46
48
60
64
68
66
44
50
16
68
52

1
54
2
56
3
58
46

140
142
148
RETURN 1 MILLION ACCLAIM POINTS TO DECK
150
1 MILLION
144
5 MILLION
APATHY
146

104
108
106
102

DISARMAMENT GAME APPARATUS

BACKGROUND

The present invention relates to apparatus for playing a board game based on disarmament.

A popular category of board games in the prior art involves a confrontation between opposing forces representated by corresponding sets of tokens. Checkers, chess, and other "war" games are examples within this category.

In many such games, the progress of the game is measured by comparing the number of tokens removed from the board by the players, taking into consideration the relative value of the tokens.

A disadvantage of many existing games in the prior art is that they teach strategies of annihilation that are increasingly unpopular in the present nuclear age.

Another disadvantage of the games of the prior art is that the progress thereof is not readily determined, especially when there are a plurality of kinds of the tokens having differing values.

Thus there is a need for a confrontational board game that relates to disarmament, in which the cumulative effect of transactions in tokens having a plurality of values is readily apparent.

SUMMARY

The present invention is directed to apparatus for a disarmament game that satisfies this need. The apparatus includes a supply of tokens comprising a plurality of visually distinguishable kinds, the tokens of each kind individually having equal mass, the mass of each kind being proportional to a corresponding point value associated with each kind. The apparatus further includes a scale for balancing sets of the tokens corresponding to opposing players of the game, the scale indicating the relative mass between the sets, means for permitting transactions in the tokens whereby there is a change in at least one of the sets of the tokens, and means for limiting the transactions according to the indication of the scale. Thus the scale provides a convenient and rapid indication of the progress of the game, while at the same time adding depth to the game by altering its progress.

Preferably the kinds of the tokens represent corresponding strategic weapons available to opposing cartels that are represented by the players. Preferably one kind of the tokens represents manned bomber aircraft, another kind represents submarine launched ballistic missiles, and a further kind represents intercontinental ballistic missiles. Preferably the tokens are weighted such that the submarine launched ballistic missiles have double the mass of the bomber aircraft, and the intercontinental ballistic missiles have three times the mass of the bomber aircraft for simulating the relative destructive capability of the strategic weapons.

Preferably the game apparatus includes a game board on which the cartels are mapped thereon as eastern and western powers having weapon site locations corresponding to those of Soviet Russia and the United States.

Preferably the scale indicates a balanced condition when the total mass of the first set of tokens equals the total mass of the second set of token. Preferably the scale can also indicate at least two degrees of imbalanced on either side of tne balanced condition. Preferably the scale has a pair of indicia patterns independently indicating for each player a degree of imbalanced depending on whether that players tokens outweigh those of the other player.

Preferably the means for permitting transactions includes a plurality of players selected groups of transaction outcomes and a chance device for defining particular outcomes within the selected groups. Preferably the means for limiting the transactions includes a plurality of sets of the outcomes, the sets corresponding to indications of the scale. Thus a particular outcome is determined by the selected group, the indication of the scale, and the chance device. Moreover, the options available to a player are dependent on the progress of the game.

Preferably the game apparatus includes means for defining odds associated with each of the outcomes independently for each of the groups and sets of potential outcomes. Preferably the chance device has stable states outnumbering the possible outcomes from which a player may choose, and the odds means includes a chart for defining the determined outcome in terms of the states of the chance device for each of the groups and sets of outcomes. Preferably the chance device is a 12-sided die.

Preferably the game apparatus includes a set of declaration cards for each player to select and temporarily store a wagered value without revealing it to the other player. Preferably the declaration cards have a plurality of demoninations, the wagered value being the total of a plurality of the cards.

Preferably the game apparatus includes selection means for randomly determining whether successive rounds of the game are arming rounds wherein tokens are added to the board or disarming rounds wherein tokens are taken from the board and added to the scale. Preferably the selection means is a spinner rotatably mounted on a surface having a dark region for indicating the arming round and a light region for indicating the disarming round.

Preferably the game apparatus includes a first deck of cards, cards of the first deck representing designated acclaim points to be drawn at rhe end of each round by the player making the greatest progress toward disarmament. Preferably the apparatus includes a second deck, cards of which have instructions for the player making the least progress toward disarmament.

By using strategy limiting the effects of turns which add contest tokens to the playing area, and increasing the effects of turns which remove contest tokens from the playing area, progress is achieved toward disarmament. To win the game, a player must succeed removing all of the tokens from his cartel while also having accumulated sufficient world opinion points to account for the remaining tokens in the other cartel. Thus the game realistically simulates the role of world opinion in deterring aggression.

DRAWINGS

These and other features, aspects, and advantages of the present invention will become better understood with reference to the following description, appended claims, and accompanying drawings where:

FIG. 1 is an oblique side elevational perspective view of game apparatus according to the present invention, the apparatus being in a closed configuration for storage in a container (not shown), the apparatus including a game board assembly, a pair of negotiating kits, and an equipment box;

FIG. 2 is a plan view of the apparatus of FIG. 1 showing the board assembly in an open configuration for play of the game;

FIG. 3 is a fragmentary oblique perspective view of the game apparatus of FIG. 1 within region 3 of FIG. 2, and including cards from the equipment box;

FIG. 4 is a fragmentary oblique perspective view of the game apparatus of FIG. 1 within region 4 of FIG. 2, showing an odds chart from the equipment box;

DESCRIPTION

Figures 5, 6, 7, 8, 9, 10:
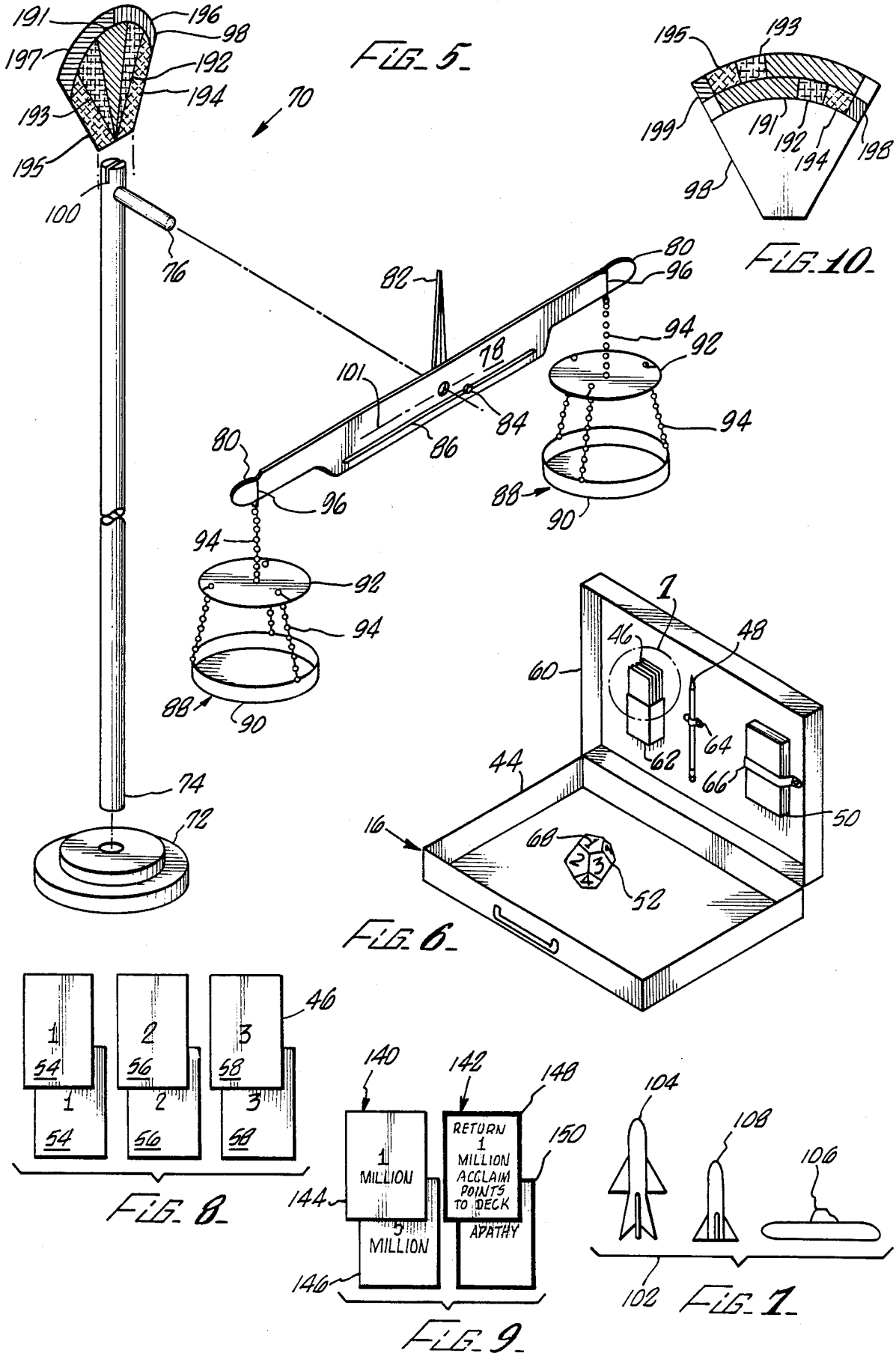
FIG. 5 is an oblique elevational perspective view of a scale assembly from the equipment box of FIG. 1.
FIG. 6 is an oblique elevational perspective view of one of the negotating kits of the game apparatus of FIG. 1.
FIG. 7 is an elevational view of three kinds of tokens for a supply of tokens included in the equipment box of game apparatus of FIG. 1.
FIG. 8 is a plan view of a set of declaration cards of the game apparatus of FIG. 1 taken from region 7 of FIG. 6.
FIG. 9 is a plan view of a pair of card decks from the equipment box of the game apparatus of FIG. 1.
FIG. 10 is a fragmentary elevational view of a portion of an alternative version of the scale assembly of FIG. 5 within region 10 of FIG. 5.

The present invention is directed to game apparatus relating to disarmament of world powers. The object of the game is to disarm a player's "cartel" without causing an unfavorable balance of power that would not be sufficiently detered by "world opinion".

Game Apparatus

With reference to FIGS. 1–10, a game apparatus 10 includes a board assembly 12, an equipment box 14, and a pair of negotiating kits 16. The board assembly 12 comprises a foldable game board 18, the game board 18 having a pair of panel members 20 and a spine member 22 therebetween. As shown in FIG. 1, the game board 18 folds for enclosing the equipment box 14 and the negotating kits 16. A card block 24, further described below, is affixed to each panel member 20 opposite the spine member 22 for accommodating the equipment box 14 and the negotating kits 16 between the card blocks 24 and the spine member 22 when the board assembly 12 is closed. The card blocks 24 each occupy half of the vertical height between the facing panel members 20. Each card block 24 has a card slot 25 for holding a pair of cards as further described below.

Opposing cartels are mapped on the game board 18, an eastern cartel 26 representing territory controlled by the Union of Soviet Socialist Republics, and a western cartel 28 representing territory controlled by the United States of America. A plurality of first weapon sites 30 is located within the eastern cartel 26 and a plurality of second weapon sites 32 is located within the western cartel 28. The first weapon sites 30 and the second weapon sites 32 are located on the game board 18 for realistically representing actual sites controlled respectively by the Soviet Union and the United States. The weapon sites 30 and 32 can signify a specific weapon type associated within a plurality of kinds of tokens described below.

The board assembly 12 includes a spinner 34 for determining whether successive rounds of the game are to be "Arming Rounds" or "Disarming Rounds" as further described below. The spinner 34 is rotatably mounted on a dial region 36 of the game board 18. The dial region 36 comprises in equal portions a white region 38 and a black region 40 within the game board 18. The white region 38 and the black region 40 subtend equal angles with respect to a spinner axis 42 of the spinner 34. Thus the Disarming Rounds and the Arming Rounds are equally likely.

Each negotiating kit 16 includes an attache case 44, a set of declaration cards 46, a pencil 48, a note pad 50, and a 12-sided die 52. The card set 46 includes a pair of "1" cards 54, a pair of "2" cards 56, and a pair of "3" cards 58. A lid 60 of the attache case 44 includes a card pocket 62 for the card set 46, a pencil holder 64 for the pencil 48, and a pad holder 66 for the note pad 50. The 12-sided die 52 has a numerical designation 68 on each of its sides for indicating a value associated with each of 12stable states of the die 52 when the die 52 is at rest. The numerical designations 68 represent integer values from 1 to 12 inclusive. Preferably the numerical designations are Arabic numerals for ease of recognition.

Alternatively the numerical designations 68 comprise dot patterns such as those on conventional six-sided dice.

With reference to FIG. 5, a scale 70 is provided for monitoring and controlling progress of the game as manifested by transactions in tokens. First and second sets of tokens are balanced on the scale for indicating a difference in mass between the sets as described below. The scale 70 includes a base 72 and a mast 74 having a fulcrum pin 76 extending perpendicular to the mast 74 from a point located proximate to one end thereof. The mast 74 is removably insertable into the base 72 for locating the fulcrum pin 76 in a raised position and horizontally oriented above the base 72. A balance arm 78, pivotably mountable on the fulcrum pin 76 has a pair of hook members 80 at opposite ends thereof, the hook members 80 being equidistant from the fulcrum pin 76. A pointer 82, fixedly attached to the balance arm 78, extends perpendicular to the balance arm 78 from a point located proximate to the fulcrum, pin 76. An adjustment fitting 84 is slidably mounted in an adjustment slot 86 for trimming the balance arm 78. The adjustment slot 86 extends from a point located proximate to the fulcrum pin 76 opposite the pointer 82 part way toward each of the hook members 80.

A basket 88 is suspended from each of the hook members 80 of the balance arm 78. Each basket 88 comprises a pan 90 and a yoke disc 92, the yoke disc 92 being connected to the pan 90 by three equally spaced lengths of beaded chain 94. An additional length of the chain 94 is connected between a loop member 96 and the yoke disc 92 at a point centrally located thereon for suspending the pan 90 from the corresponding hook member 80. An indicia card 98 is removably insertable in a mast slot 100 at the top of the mast 74 for indicating the position of the pointer 82 as further described below. The scale 70 can be partially disassembled for storage in the equipment box 14.

Preferably the balance arm 78 comes to rest in a stable position corresponding to each of a plurality of mass differences between the contents of rhe baskets 88. For this purpose, the balance arm 78 is configured with its center of gravity below the center of the fulcrum pin 76, the baskets 78 being effectively suspended from points located on a line 101 passing through the center of the fulcrum pin 76.

The indicia card 98 has a central green region 191 for indicating a balanced condition of the scale 70, a pair of yellow regions 192 and 193 on opposite sides of the green region for indicating a "yellow" condition of imbalance, and a pair of orange regions 194 and 195 on opposite sides of the yellow regions for indicating a further "orange" condition of imbalance. The indicia card 98 also has a red side 196 and a blue side 197 for distinguishing the direction of imbalance, the red side 196 extending toward the right from above the central green region 191, the blue side 197 extending toward the left from the central green region 191, the red side 196 being associated with the eastern cartel 26, the blue side 197 being associated with the western cartel 28.

Alternatively, as shown in FIG. 10, the indicia card 98 comprises a "red band" 198 and a "blue band" 199, the yellow region 192 and the orange region 194 on the right side of the indicia card 98 being associated with the red band 198, the yellow region 193 and the orange region 195 on the left side of the indicia card 98 being associated with the blue band 199. The central green region 191 extends within the red band 198 beneath the yellow region 193 and the orange region 195 on the left side of the indicia card 98. Conversely, the central green region 191 extends within the blue band 199 above the yellow region 192 and the orange region 194 on the right side of the indicia card 98. Thus the indicia card 98 provides separate indications of "yellow" and "orange" conditions of imbalance for the eastern cartel 26 and the western cartel 28.

With reference to FIG. 7, the equipment box 14 includes a supply of tokens 102, the tokens 102 representing a plurality of types or kinds of strategic weapons available to the eastern cartel 26 and the western cartel 28. One example of each kind of the tokens 102 is shown in FIG. 7. A first kind 104 of the tokens 102 is visually representative of a manned bomber aircraft. A second kind 106 is shaped like a submarine for representing a submarine launched ballistic missile. A third kind 108 of the tokens 102 visually represents an inter-continental ballistic missile. Each of the kinds of the tokens 102 is uniformly weighted for representing by its mass the destructive capability of the type of weapon represented by that kind. The first kind 104 has a small mass for indicating one "Unit of Destruction" associated with the long range bomber, primarily a second strike weapon. The second kind 106 is weighted with double the mass of the first kind 104 for indicating two "Units of Destruction" assigned to the submarine launched ballistic missile, the most survivable of the weapons. The third kind 108 of the tokens 102 is weighted with three times the mass of the first kind 104 for indicating three "Units of Destruction" assigned to the inter-continental ballistic missile.

The equipment box 14 includes an odds chart 110 for listing a plurality of transaction outcomes in terms of player-selected choices, the stable states of the die 52 and the indications of the scale 70. As shown in FIGS. 2 and 4, the odds chart 110 is folded into a pair of tables or chart panels 112 for supporting the odds chart 110 in an uprignt position for reference by opposing players of the game. The odds chart 110 can be placed conveniently on the board 18 with the chart panels 112 standing in a pair of joint grooves 114, the joint grooves 114 being provided between the spine member 22 and the adjoining panel members 20 for folding of the board 18. The information contained in the odds chart 110 is duplicated on each of the chart panels 112 for convenient simultaneous access to the information by the opposing players.

Each chart panel 112 has a scale correlator band 116 along one side thereof for assocating a plurality of sets of potential outcomes with corresponding indications of the scale 70. The correlator band 116 has a green element 118, a yellow element 120, and an orange element 122 corresponding to the balanced condition of the scale 70, and the "yellow" and "orange" conditions of imbalance thereof.

A selection band 124 is provided across the top of each chart panel 112 for designating a plurality of odds categories for each player selection. The selection band 124 has a first element 126, a second element 128, and a third element 120 designating odds categories "A", "B", and "C", respectively. An array of outcome cells 132 is aligned with the correlation band 116 and the selection band 114, rows of the cells 132 corresponding to the elements 118–122 of the correlator band 116 and columns of the cells 124 corresponding to the elements 126–130 of the selection band 124. Thus a particular cell 132 is defined by the intersection of a selected odds category or group of outcome cells with the element of the correlator band 116 that corresponds to the indication of the scale 70.

Each outcome cell 132 defines a plurality of numerical outcomes and a corresponding range of states of the die 52. Thus for each of the 12 states of the die 52, one of the numerical outcomes is defined. As shown in FIG. 4, a first range 134 defines a numerically positive outcome 135, a second range 136 defines a null outcome 137, and a third range 138 defines a negative outcome 139.

For example, if a player selects odds category "B" (indicating the second element 128) when the indication of the scale 70 corresponds to the yellow element 120, the outcome, after a roll of the die 52, is as follows:

| Die State | Outcome |
|---|---|
| 1–5 | Plus 2 |
| 6–7 | No change |
| 8–12 | Minus 2 |

The equipment box 14 also holds two decks of cards, an acclaim deck 140 and a disapproval deck 142, shown in FIG. 9. The cards of the acclaim deck 140 are colored white; contrastingly, the cards of the disapproval deck 142 are colored black. The acclaim deck 140 includes a "one m:llion" card 144 for indicating one million "Acclaim Points," and a "five million" card 146 for indicating five million Acclaim Points of "world opinion". The disapproval deck 142 includes an instruction card 148 and an "Apathy Card" 150.

The acclaim deck 140 also includes cards (not shown) in other denominations of Acclaim Points, and an Apathy Card. The disapproval deck 142 also includes cards (not shown) having other instructions to be followed.

Preferably multiple copies of at least some of the instruction cards are included in the disapproval deck 142 for providing a predetermined likelihood of drawing a particular instruction. Preferably the instructions and associated likelihoods are as follows:

| Likelihood (%) | Instruction |
|---|---|
| 25 | Return 1 million acclaim points to deck. |
| 10 | Add equivalent of 2 units of destruction to your side of the board. |
| 25 | Begin next round with 1 wager card face up. |
| 20 | Relinquish next turn as round leader. |

-continued

| Likelihood (%) | Instruction |
|---|---|
| 20 | Return 1 million acclaim points and add 1 unit of destruction to your side of the board. |

RULES OF THE GAME

Set-Up

Each player selects one of the negotating kits 16 and a side of the gameboard 18. The scale 70 is removed from the equipment box 14, assembled, positioned, and adjusted by moving the adjusting fitting 84 for centering the pointer 82 on the indicia card 98. Preferably the scale 70 is positioned with the red side 196 and the blue side 197 oriented respectively toward the eastern cartel 26 and the western cartel 28.

The tokens 102 are placed on the first weapon sites 30 and the second weapons sites 32 on the gameboard 18 so that the total Units Of Destruction of the eastern cartel 26 matches the total Units Of Destruction of the western cartel 28. The player selecting the eastern cartel 26 is desginated the "Red Player" and the player selecting the western cartel 28 is designated the "Blue Player". The cards of the acclaim deck 140 and the disapproval deck 142 are shuffled and placed face down on the board 18. The odds chart 110 is placed within the chart panels 112 thereof engaging the joint grooves 114 of the gameboard 18.

Each player rolls the die 52. The player with the highest roll is the initial "Round Leader." From this point, role of Round Leader alternates from round to round throughout the game.

Negotiating Rounds

Step One: THE WAGER. Each player secretly selects any two cards of his/her card set 46 from the attache case 44, placing them in the card slot 25 of his/her card block 24, the cards facing away from the opposing player, the total of the two cards defining a "Wagered Value".

Step Two: THE DECLARATION. Starting with the Round Leader, each side verbally declares the total point value of the two cards from the card set 46. The amount declared does not have to be the actual amount wagered.

Step Three: THE CHALLENGE. Starting with the Round Leader, each player optionally accepts or challenges the declaration of the opposing player.

If a player's declaration is accepted, that player has the option to use the actual Wagered Value, or the declared value when computing points at the end of the round. If a player's declaration is challenged, that player must then show his/her cards. If the declaration was truthful, the challenging player must then immediately add the equivalent of two Units Of Destruction to his/her cartel. If the declaration was untruthful, the declaring player must immediately add the equivalent of one Unit of Destruction to his/her cartel on the gameboard 18.

Step Four: THE SPIN. The Round Leader spins the spinner 34. If the spinner 34 stops in the white region 38, then the round becomes a "Disarm Round," and points computed at the end of the round represent Units of Destruction removed from the board. If the spinner 34 stops in the black region 40, then the round becomes a "Arm Round" and points computed at the end of the round reflect Units of Destruction added to the board. If the spinner 34 stops between the white region 38 and the black region 40, the Round Leader spins the spinner 34 again.

Step Five: THE DIE. Beginning with the Round Leader, each player checks the odds chart 110 and openly declares an odds category from the selection band 124. Each side then rolls his/her die 52 for determining a numerical outcome to be added or subtracted from the original wagered or declared amount from steps 1 and 2. The outcome is defined by the outcome cell 132 that corresponds to the selected odds category and the position of the pointer 82 of the scale 70 on the indicia card 98 as follows:

(a) if the pointer 82 is in the central green region 191, both players use the outcome cell 132 corresponding to the green element 118 for his/her odds category;

(b) if the pointer 82 is on the red side 196 of the indicia card 98, indicating that the Red Player has moved to his/her basket 88 tokens representing more Units of Destruction from his/her cartel on the game board 18, then the Red Player uses the green element 118, the yellow element 120, or the orange element 122 corresponding to the position of the pointer 82 on the indicia card 98, out the Blue Player must use the green element 118; and (c) if the pointer 82 is conversely on the blue side 193 of the indicia card 98, then the Red Player must use the green element 118, but the Blue Player uses the green element, the yellow element 120, or the orange element 122 corresponding to the position of the pointer 82 on the indicia card 98.

Wnen the indicia card 98 is in the alternative configuration as shown in FIG. 10, the outcome is defined by the outcome cell 132 that corresponds for each player to the selected odds category and the position of the pointer 82 of the scale 70 on the indicia and 98 as follows:

(a) the Red Player uses the green element 118, the yellow element 120, or the orange element 122 corresponding to the position of the pointer 82 on the red band 198; and (b) the Blue Player uses the green element 118, the yellow element 120, or the orange element 122 corresponding to the postion of the pointer 82 on the blue band 199.

Step Six: THE COMPUTATION. A "Round Total" is calculated for each player by adding the amount wagered in step one (or the declared amount in Step 2, if it has not been challenged) to the outcome resulting from the roll of the die 52 in Step 5. For example, if the original wager was 5 and the outcome was −2, then the round total for that player is 3.

Step Seven: THE ACT. Depending on the outcome of the spin in Step 4, each side adds weapons (tokens) to the board 18 (Arm Round) or subtracts weapons from the board and adds them to hers/her basket 88 on the scale 70 (Disarm Round), the Round Total for that player determining the total Units of Destruction to be added or subtracted from the board. The tokens removed from the board are accumulated on the scale as first and second sets of the tokens corresponding to the Red Player and the Blue Player respectively.

The position of the pointer 82 of the scale 70 changes when tokens are removed from the board and placed in the basket 88 of the scale 70. Thus the outcome of successive rounds of the game is affected by the number of Units of Destruction that a player succeeds in adding to his/her basket 88 of the scale 70. The scale 70 also provides a convenient indication of progress of the game in terms of the difference in the Units of Destruction removed from the board 18 by the opposing players.

Step Eight: THE REPERCUSSIONS. At the end of each round, the player who has added the fewest weapons to his cartel or subtracted the most weapons from his cartel (achieving the largest gain toward global disarmament) is declared the "Round Winner" and draws a card from the acclaim deck 140. The other player or "Round Loser" draws a card from the disapproval deck 142.

A. Acclaim. Any combination of cards from the acclaim deck 140 totaling ten million World Opinion points or more may be redeemed to either reduce or increase an opponents final computation in any one round by a factor of one-half. These cards may be accumulated by the respective players and used at any time during the game. Any combination of these cards totaling 20 million World Opinion points or more may be redeemed either to reduce or increase a player's own round total by a factor of one-half.

B. Disapproval. The Round Loser must immediately read the instruction on an instruction card drawn from the disapproval deck 142 aloud when drawn and follow the instructions thereon.

C. Apathy. World apathy cards from the acclaim deck 140 or the disapproval deck 142 may be produced to negate actions required by cards of either the acclaim deck 140 or the disapproval deck 142. When the apathy card 150 of the disapproval deck 142 is drawn it must be declared and then may be saved for future use.

End of Game

The game ends when a round of negotiations results in all of the Units of Destruction being removed from either the eastern cartel 26 or the western cartel 28. If the other cartel has 10 or fewer Units of Destruction remaining then the player removing all of his Units of Destruction is the winner. Otherwise the player having remaining Units of Destruction wins unless the other player has at least five million World Opinion Points for each of the remaining Units of Destruction.

Although the present invention has been described in considerable detail with reference to certain preferred versions thereof, other versions are possible. For example, the game can be played by three players by adding a "southern cartel" and using a scale that has two degrees of freedom. Also, the game can be played by teams of players. Therefore, the spirit and scope of the appended claims should not necessarily be limited to the description of the preferred versions contained herein.

What is claimed is:

1. A game apparatus for first and second players, comprising:

(a) a supply of tokens, the supply comprising a plurality of visually distinguishable different kinds of tokens, the tokens of each kind being of equal mass, the mass of each kind being in a predetermined ratio to the mass of the other kinds corresponding to a numerical point value associated with each kind;

(b) a scale for balancing a first set of the tokens corresponding to the first player against a second set of the tokens corresponding to the second player, the scale indicating the relative mass between the sets;

(c) means for permitting transactions of the tokens whereby the mass of at least one of the sets of the tokens is changed, comprising:

(i) a chance device having a plurality of stable states; and (ii) means for selecting from a plurality of player-selected groups of potential transaction outcomes, the potential outcomes being functionally related to stable states of the chance device;

(d) means for limiting the transactions according to the indication of the scale, comprising a plurality of sets of the potential outcomes, the sets of the potential oucomes being correlated to the indication of the scale, whereby a determined transaction outcome is defined by the selection from the groups, the indication of the scale, and the state of the chance device; and (e) means for independently defining odds associated with each of the potential outcomes for each of the groups and each of the sets of potential outcomes.

2. The game apparatus of claim 1 wherein the change device has a plurality of stable states in excess of the number of potential outcomes corresponding to a given intersecting group and set of the potential outcomes and the odds means comprises a table for defining the determined outcome as a function of the stable states of the chance device for each group and set of the potential outcomes.

3. A game apparatus for first and second players, the game to be played in rounds, the apparatus comprising:

(a) a supply of tokens, the supply comprising a plurality of visually distinguishable different kinds of tokens, the tokens of each kind being of equal mass, the mass of each kind being in a predetermined ratio to the mass of the other kinds corresponding to a numerical point value associated with each kind;

(b) a scale for balancing a first set of the tokens corresponding to the first player against a second set of the tokens corresponding to the second player, the scale indicating the relative mass between the sets;

(c) means for permitting transactions of the tokens whereby the mass of at least one of the sets of the tokens is changed;

(d) means for limiting the transactions according to the indication of the scale;

(e) a game board having eastern and western cartels mapped thereon, respective cartels each including a plurality of site designations representing corresponding locations for weapons controlled respectively by the Union of Soviet Socialist Republics and the United States of America; and (f) round selection means for randomly determining for each round whether the round will be an arming round wherein tokens are added to the board or a disarming round wherein tokens are taken from the board and added to the scale.

4. The game apparatus of claim 3 wherein the round selection means is a spinner mounted for rotation on a spinner surface, the spinner surface having a dark region for indicating the arming round and a light region for indicating the disarming round.

5. The game apparatus of claim 3 further comprising a first deck of cards, at least some of the cards thereof representing a designated number of acclaim points, a card to be drawn from the first deck at the end of each round by the player that has added the least total mass of tokens to the board or removed the greatest total mass of tokens from the board in that round, the acclaim points being accumulated for permitting all of the tokens to be safely removed from one of the cartels depending on the remaining tokens in the other cartel.

6. The game apparatus of claim 3 further comprising a second deck of cards, at least some of the cards thereof having an instruction written thereon, a card to be drawn from the second deck at the end of each round by the player that has added the greatest total mass of tokens to the board and removed the least total mass of tokens from the board in that round, that player being required to follow the instruction thereon.

7. A game apparatus for first and second players comprising:

(a) a game board having first and second cartels mapped thereon, the respective cartels each including a plurality of site designations representing corresponding locations for weapons controlled respectively by the Union of Soviet Socialist Republics and the United States of America, the first and second cartels corresponding respectively to the first and second players;

(b) a supply of tokens, the supply comprising a plurality of visually distinguishable different kinds of tokens, the kinds of tokens being representative of a plurality of strategic weapons available to the cartels, the tokens of each kind being of equal mass, the mass of each kind being in a predetermined ratio to the mass of the other kinds corresponding to a destructive point value associated with each kind;

(c) means for permitting initial complements of the tokens to be applied respectively to the eastern cartel and the western cartel on the game board.

(d) a scale for balancing a first set of the tokens removed from the first cartel against a second set of the tokens removed from the second cartel, the scale being capable of indicating a balanced condition wherein the total mass of the first set of tokens is approximately equal to the total mass of the second set of tokens, and at least 2 degrees of imbalance in the relative mass between the sets on either side of the balanced condition, the scale having a pair of indicia patterns independently indicating for each player a degree of imbalance depending on whether the first set of the tokens or the second set of the tokens has the greater total mass;

(e) means for permitting transactions of the tokens whereby the mass of at least one of the sets of the tokens is changed, comprising:

(i) a chance device having a plurality of stable states; and (ii) means for selecting from a plurality of groups of potential transaction outcomes, the potential outcomes being functionally related to the stable states of the chance device; and (f) means for limiting the transactions comprising a plurality of sets of the potential transaction outcomes, the sets of potential outcomes being correlated to the indication of the scale, whereby a determined outcome is defined by the selection from the groups, the indication of the scale, and the state of the chance device.

* * * * *